United States Patent [19]

Pfleiderer et al.

[11] Patent Number: 4,968,621

[45] Date of Patent: Nov. 6, 1990

[54] METHOD FOR THE WET DEGREASING OF HIDE AND SKIN STOCK

[75] Inventors: Ernst Pfleiderer, Darmstadt-Arheilgen; Tilman Taeger, Griesheim; Gertrud Wick, Weiterstadt, all of Fed. Rep. of Germany

[73] Assignee: Röhm GmbH, Darmstadt, Fed. Rep. of Germany

[21] Appl. No.: 391,638

[22] Filed: Aug. 7, 1989

Related U.S. Application Data

[63] Continuation of Ser. No. 88,467, Aug. 19, 1987, abandoned, which is a continuation of Ser. No. 594,711, Mar. 29, 1984, abandoned.

[30] Foreign Application Priority Data

Apr. 9, 1983 [DE] Fed. Rep. of Germany ..... 3312840

[51] Int. Cl.[5] ..... C14C 1/06; C14C 1/08

[52] U.S. Cl. ..... 435/265; 435/267

[58] Field of Search ..... 435/265

[56] References Cited

U.S. PATENT DOCUMENTS

| | | | |
|---|---|---|---|
| 2,121,823 | 6/1938 | Piggott | 8/94.18 X |
| 2,871,162 | 1/1959 | Burton | 435/265 |
| 2,965,678 | 12/1960 | Sundberg | 8/94.18 X |
| 3,076,749 | 2/1963 | Grimm | 435/265 |
| 3,203,868 | 8/1965 | Grimm | 435/265 |
| 3,558,430 | 1/1971 | Monsheimer et al. | 435/265 |
| 3,986,926 | 10/1976 | Monsheimer et al. | 435/265 |
| 4,260,686 | 4/1981 | Asbeck et al. | 435/265 |
| 4,273,876 | 6/1981 | Monsheimer et al. | 435/265 |
| 4,314,801 | 2/1982 | Monsheimer et al. | 435/265 X |
| 4,344,762 | 8/1982 | Monsheimer et al. | 435/265 X |

FOREIGN PATENT DOCUMENTS

| | | |
|---|---|---|
| 203511 | 12/1955 | Australia . |
| 252426 | 4/1963 | Australia . |
| 271882 | 7/1963 | Australia . |
| 280664 | 8/1965 | Australia . |
| 431017 | 3/1970 | Australia . |

OTHER PUBLICATIONS

Leather Technical Glossary in Six Languages, Roether Verlag, Darmstadt, pp. 60, 62, 132, 464.

Kirk-Othmer, Encyclopedia of Chemical Technology, vol. 8, John Wiley & Sons, New York, p. 910.

Emulsions, Becher, ACS Monograph, Reinhold, New York, pp. 20–21.

Proceedings, 7th Congress on the Leather Industry, Omikk-Technoinform Budapest, 1982, pp. 277–288.

Kirk-Othmer, Encyclopedia of Chemical Technology, vol. 8, p. 294, The Interscience Encyclopedia, Inc., New York.

Prentiss, JALCA 71, 54–63 (1976).

Diefendorf et al., JALCA 78, 156–165 (1983).

*Primary Examiner*—Sam Rosen

*Attorney, Agent, or Firm*—Curtis, Morris & Safford

[57] ABSTRACT

A method for the wet degreasing of raw hides and skins, pelts, and wet blues under the conditions of enzymatic bating, wherein enzymatic bating of the hide stock is carried out with proteolytic enzymes in the presence of synthetic surface active substances, for example, a mixture of a non-ionic emulsifier and anionic emulsifier.

14 Claims, No Drawings

METHOD FOR THE WET DEGREASING OF HIDE AND SKIN STOCK

This is a continuation of Ser. No. 088,467 filed Aug. 19, 1987 and now abandoned, which is a continuation of application Ser. No. 594,711, filed Mar. 29, 1984 and now abandoned.

The present invention relates to a method for the wet degreasing of hides and skins, and particularly of raw hides, skins, pelts, and wet blues, in the course of leather processing.

While in the case of calfskins, cattle hides, and goatskins the normal content of natural fat usually is less than 1 weight percent based on the dry weight of the hide stock and as a rule is reduced still further in the subsequent beamhouse operations so that generally no difficulties are encountered in tanning and finishing, this is not the case with skins that are higher in natural fat, and especially with sheepskins. Even after they have been put through the beamhouse, such hides and skins have a high residual fat content which, in the tanning that follows, results in the nonuniform takeup of tanning agents by the hide or skin, and consequently in grease stains, nonuniform dyeing, and finishing difficulties.

In the hides and skins which are higher in fat content (for example, sheepskins, goatskins, and cattle hides), the natural fat to be removed is deposited mostly at the boundary between the papillary and reticular layers and also in the subcutaneous connective tissue, and more particularly in the interior of fat cells which are embedded in collagenous connective tissue. Whether this embedded natural fat can be removed depends, among other things, on whether the membranes of the fat cells can be rendered sufficiently permeable or whether they can be destroyed, and on whether the collagenous enveloping tissue can be sufficiently loosened. [See F. Stather, Gerbereichemie und Gerbereitechnologie ("Tanning Chemistry and Tanning Technology"), Akademie-Verlag, Berlin, 1967.]

Fat dissolving emulsifiers have long been used to degrease hides and skins. The treatment frequently proceeds with aqueous solutions which contain emulsified fat solvents. (See F. Stather, loc. cit., p. 208.) A wide variety of emulsifying and wetting agents, and particularly fatty alkyl sulfates and soaps, are used as emulsifiers, while gasoline or chlorinated hydrocarbons are used as emulsified fat solvents. According to U.S. Pat. No. 2,343,929, an emulsion of trichloroethylene, water, and sulfonated oleyl alcohol, for example, is suitable for the degreasing of hides and skins.

German patent No. 913,094 proposes the concurrent use of chlorinated hydrocarbons and the products of saponification of sulfochlorinated saturated hydrocarbons having a chain length of $C_{12}$ to $C_{24}$ as emulsifiers.

The concurrent use of various types of emulsifiers is recommended in German patent No. 759,631, which points out that the tendency of alkylsulfonic salts to proteolysis is a drawback.

In the prior art, lipases, too, are often used to degrease skins. (See Chem. Abstr. 97, 57467; 89, 199097c; 90, 205804v; 82, 74484a.) According to Chem. Abstr. 88, 171809, the lipolytic activity of an enzyme is considerably reduced by the surface active agent used. According to Chem. Abstr. 82, 113205g, none of the usual methods (ultrasonics, lipase action, or solvent extraction) will remove more than 50 percent of the fat in pigskins. It is pointed out that enzymatic lipolysis with lipase must be closely controlled since the enzyme is capable of decomposing collagen. Where enzymatic lipolysis is employed, it is effected by means of lipases and/or enzyme preparations containing lipase, in keeping with the chemical nature of the substrates, usually in the pH range below 8, and preferably in a moderately acid pH range.

The detrimental effect with emulsifiers, particularly ionic emulsifiers, and other surface active agents have on enzymes is widely documented.

The wet degreasing of hides and skins, pelts and wet blues is increasingly beset by problems, including antipollution regulations. For example, there are serious objections from the viewpoint of ecology, safety, and/or industrial hygiene to the use of halogenated hydrocarbons and certain more volatile fat solvents in the degreasing of hides and the like.

Since, as a rule, reduction of natural fat content to about 2 percent, based on the dry weight of the hides, will satisfy the technical requirements concerning further processability and, ultimately, the quality of the leather produced, the object of the invention is the degreasing of hides, skins, pelts and wet blues which contain more than 2 weight percent of natural fat, based on the weight of the stock. This category includes, in particular, cattle hides of certain origins, for example the United States and Queensland, English ox hides, and Scandinavian hides, as well as pigskins of practically any provenance, sheepskins, lambskins, pickled skins, (especially those from New Zealand), and goatskins. Because of the modern trend toward the use of fattening feeds, the natural fat content of hides and skins of practically any origin has increased considerably over the last decade. Today it often exceeds tolerable levels and gives rise to the difficulties in leather manufacture mentioned earlier.

These difficulties are compounded by the fact that the fat deposits are not uniformly distributed over the surface of the hide; rather, there are high fat and low fat zones. In places with pronounced natural fat deposits, diffusion of the commonly used chemicals and auxiliary agents is rendered more difficult and often a uniform effect over the entire cross section of the hides and skins is not obtained. The severity of these problems increases with the thickness of the hide or skin.

Accumulations of fat result in insufficient softening action and, consequently, in insufficient opening of the hide structure in liming. Areas of the hide which have not been sufficiently opened up in liming cannot be tanned through and result in uneven distribution of the tanning material over the cross section of the hide. Nonuniform penetration of the tanning material in turn results in nonuniform reaction in the subsequent operations, such as neutralization, retannage, dyeing, and fatliquoring. Higher natural fat contents of the grain layer always result in nonuniform dyeing, which is detrimental especially to full grained, aniline dyed leathers. Higher natural fat contents also reduce the adhesive strength of the finish and further result in poorer physical properties, such as poorer tear resistance.

In carrying out the object of the invention, it should be possible substantially to adhere to the existing and proven technology, both in the beamhouse and in the subsequent steps of tanning, retannage, fatliquoring, dyeing, etc.

The object of the invention is accomplished by a method wherein an enzymatic bating of skin stock with proteolytic enzymes is carried out in the presence of synthetic surface active substances.

Suitable synthetic surface- active substances are, for example, the commonly used emulsifying agents, and particularly those suited for the emulsification of fat in water. (See British patent No. 586,540, German patent No. 894,142, and French patents Nos. 899,983 and 918,523.) Nonionic emulsifiers of the following types, for example, are primarily suitable for use in the method of the invention:

(A) Polyglycol derivatives
(a) Fatty acid polyglycols,
(b) Fatty alcohol polyglycol ethers,
(c) Alkylphenol polyglycol ethers, and
(d) Fatty acid ethanolamide polyglycol ethers.
(B) Glycerol derivatives
(a) Fatty acid monoglycerides, and
(b) Fatty acid polyglycerol esters.

Anionic emulsifiers of the following types, for example, are also suitable for use:

(C) Sulfates R—$OSO_3Na$
(a) Fatty alkyl sulfates, both primary, and secondary,
(b) Ethoxylated fatty alkyl sulfates,
(c) Monoglyceride sulfates, and
(d) Products of sulfation of unsaturated oils and fatty acids.
(D) Sulfonates R $SO_3Na$
(a) Alkylbenzene sulfonates,
(b) Alkyl sulfonate,
(c) Fatty acid condensation products,
(d) Petroleum sulfonates
(e) Products of sulfitation of unsaturated fatty oils and fatty acids,
(f) Short chain alkylbenzene sulfonates, e.g. of cumene, toluene or xylenol.

Less advantageous are cationic emulsifiers, for example, those of the types:

(E) Amine salts RNR, $R_2$ Hx

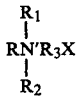

(a) Ammonium salts,
(b) Pyridinium salts, wherein R is a long chain alkyl group having from 8 to 24 carbon atoms and $R_1$, $R_2$ and $R_3$ are short chain alkyl groups having up to 6 carbon atoms.

The emulsifiers suitable for use in accordance with the invention have hydrophile-lipophile balance (HLB) (oil in water emulsion) ranging from 8 to 18, more particularly from 9 to 15, and preferably from 12 to 15. (See Ullmanns Enzyklopädie der technischen Chemie, 4th ed., vol. 10.) Combinations of emulsifiers, and particularly of nonionic and anionic emulsifiers, may also be used to advantage. Ethoxylated alkylphenols (alkylphenol polyglycols) with a degree of ethoxylation (ethylene oxide units) ranging from 4 to 40, and preferably with 6.5 moles ethylene oxide and/or with 12 ethylene oxide units per nonylphenol, are particularly suitable, optionally combined with anionic emulsifiers.

The concurrent use of proteolytic enzymes in some steps of the beamhouse operations is known per se. An enzymatic bating process is known from German patent No. 974,813 in which enzymes derived from microorganisms, and plant, animal, mineral, or synthetic oils act on the skins either simultaneously or successively. According to German patent No. 1,120,066, enzyme preparations may be used in bating with the addition of optionally emulsified oils.

The proteases which are used in the wet degreasing process under bating conditions in accordance with the invention should be selected with due regard to the pH conditions of the bating process. Thus, both alkaline to neutral and acid proteases may be used. Alkaline proteases here are proteases which are active (usually against casein) in the alkaline pH range (pH 8 and up). Among these are the pancreatic proteases, the alkaline bacterial proteases (EC 3.3.21.14), and the alkaline fungal proteases, for example. Particularly well suited for use are the proteases obtained from bacillus species such as *B. subtilis, B. alcalophilus, B. licheniformis, B. coreus,* and *B. mycoides,* and especially the so-called subtilisins.

Of interest are, moreover, the neutral proteases, which are active (against casein or hemoglobin) in the pH range from 6 to 9. These include neutral bacterial proteases (EC 3.4.24.4.) and neutral fungal proteases, for example, aspergilli such as *A. oryzae.* Also of interest are the acid proteases, for example those of animal origin such as pepsin and trypsin, plant proteases such as papain, and proteases of microbiological origin such as the fungal proteases, and particularly those from aspergilli, and more particularly from *A. saitoi, A. oryzae,* and *A. niger,* from penicillia such as *P. roqueforte,* from *Rhiz. chinensis* or from *Mucor pusillus.* Their activity (against hemoglobin) is in the range from pH 2 to pH 7. It has been found that the degreasing process of the invention is carried out to great advantage as part of the bating process described in U.S. Pat. No. 4,273,876, in other words by the concurrent use of proteases and amylases during acid bating.

The amount of the enzymes in the enzymatic mixture will generally range from 0.01 to 0.2 weight percent, based on the weight of the hide stock, for enzyme products with from 300 to 10,000 and preferably from 1,000 to 5,000 Löhlein-Volhard units/gram, the amount depending on the activity of the enzymes used. In a particularly preferred embodiment, mineral oils containing from 45 to 50 weight percent of aromatic hydrocarbons (e.g. "Gravex Oil 917", a product of Shell) may also be simultaneously added to the degreasing mixture in an amount ranging from 0.1 to 5.0 weight percent, based on the weight of the hide stock.

Moreover, the addition of auxiliary substances such as hydrotropes, for example urea, and/or of cumene sulfonate has proved helpful. These should be used in amounts ranging from 0.01 mole to 1 mole/liter, and preferably from 0.02 to 0.2 mol/liter.

The facts set forth in outlining the object of the invention make it clear why degreasing is best carried out in several steps in different beamhouse operations. It has been found that the soaking and bating operations are particularly well adapted to wet degreasing. Surprisingly, the concurrent use of proteolytic enzymes and synthetic surface active substances (emulsifying agents), optionally in the presence of fat solvents, produces a synergistic effect several times greater than the effect of the individual components (enzymes and emulsifiers).

On the other hand, past experience indicates that in the liming operation no appreciable improvement in wet degreasing is obtained when synthetic surractants are used in the usual concentrations.

In the process of the invention, the following procedure may be employed:

(a) Salted raw hides are preferably subjected to a cleansing soak in a drum, paddle vat, or mixer with about 1 to about 400 percent of water at 25° to 28° C. for about 2 hours.

A small amount of surfactants (from 0.2 to 0.5 percent, based on the salted weight) may be added even to this bath. However, the amounts of fat so emulsified usually are minor.

(b) After the liquor has been replaced, soaking is started. Soaking is likewise carried out with about 1 to about 400 percent of water (guide value) and at 26° to 28° C. Proteolytic enzymes of the types indicated are added to the soak liquor (generally from 0.1 to 1 weight percent, based on the salted weight, of an enzyme having an activity of from 1,000 to 5,000 Löhlein-Volhard units per gram of enzyme).

Particularly preferred are proteases with optimum activity in the pH range from 9 to 11. Their use results in better leather qualities than can be obtained in other pH ranges.

One or more synthetic surfactants (emulsifiers) is added to the bath preferably at the same time as the enzyme. As a rule, the surfactant should be added in an amount ranging from 0.1 to 5 weight percent, and more particularly from 0.2 to 1.5 weight percent, and preferably in an amount of 0.5±0.2 weight percent, based on the weight of the hide stock.

The soaking treatment should be carried out for 4 to 6 hours.

For determination of the degreasing effect, samples should be taken from the bath before soaking is ended and analyzed for fat content, preferably by the Seesand method and with dichloromethane as fat solvent in conformity with DIN 53,345, Part 7.

As a result of the steps preceding the process in accordance with the invention, it will be observed at the conclusion of the soaking operation that in the case of cattle hides or pigskins as much as 30 weight percent of the total extractable natural fat has been removed. Liming is then carried out in the usual way. This is followed by the mechanical operations of fleshing and, in the case of cattle hides, of splitting.

Deliming and bating then follow, the latter as the process of the invention. Deliming and bating are best carried out as one continuous operation in the drum. At the start, the bath should contain about 50 weight percent of water at about 30° C. Then acid salts such as ammonium sulfate or sodium bisulfite, or a commercial deliming agent, are added in an amount ranging from 1 to 3 weight percent and the bath is agitated for about 30 minutes. When these conditions are observed, a section through the skin will show that it is largely free of lime at the end of that time. (Test with phenolphthalein solution.)

Bating in accordance with the invention then follows. From about 50 to 70 percent of water, preferably at 30° C., is added to the deliming bath, following which proteolytic enzymes, selected from those listed above, are added in the form of a bate. If desired, mineral oil containing from 45 to 50 weight percent of aromatic hydrocarbons may be added, either simultaneously or subsequently.

Based on the weight of the hide or skin stock or on the pelt weight, from 0.01 to 3 percent of enzymatic bate having a proteolytic activity from 500 to 10,000 Löhlein-Volhard units per gram of bate should be used. The amount used depends, among other things, on the origin of the raw stock from which the leather is to be made. The synthetic surfactants or the emulsifiers are added along with the bate and the bath is agitated.

The amount of the synthetic surfactants used may range from 0.05 to 5 weight percent, more particularly from 0.1 to 1.5 weight percent, and preferably ranges from 0.3 to 0.5 weight percent. The degreasing action will be enhanced by the above addition of a mineral oil containing from 45 to 50 weight percent of aromatic hydrocarbons, for example "Gravex Oil 917". The average bating time is about 1 hours at 30° C. At the end of that time, samples should be taken to determine the fat content. This determination can be made in conformity with DIN 53,345, Part 7.

In the prior art bating process, the liquor in the case of cattle hides normally has a fat content from 1 to 1 5.grams/liter. When the process of the invention is used, the liquor is found to have a fat content from 2 to 3 g/l.

The method of the invention can be carried out to advantage as an acid bating operation.

With many crude stock varieties<for example pigskins, sheepskins, goatskins, pickled pelts, splits, and wet blues, improvement of the leather quality seems to require that acid bating be carried out in addition to alkaline bating. Acid bating may also be employed without a bating operation carried out in the neutral or slightly alkaline pH range. While bating performed in the neutral or alkaline pH range produces an opening up, cleansing, and degreasing of the grain, bating carried out in the acid pH range results in an opening up and degreasing of the flesh side. The two processes thus supplement each other. In carrying them out, the skin is first drummed for 20 minutes with an approximately 5 percent solution of common salt. Then acid bates containing proteases having optimum activity in the acid pH range (pH 4 to 6) are added. They usually have an enzymatic activity from 30 to 60 $U_{Hb}$ (Anson units) and are used in an amount ranging from 0.5 to 5 weight percent, based on the weight of the skins The optimum pH of the bate enzymes is advantageously established by the addition of 0.2 to 0.5 percent of formic acid (85% technical), based on the weight of the skins, diluted with water in the ratio of 1:10. At the start, the bath is generally agitated for about 90 minutes at about 30° C. The entire treatment is carried out overnight, the bath being agitated every three hours for about 3 minutes at 30° C.

At the end of the treating time, the liquor is discarded. After an intermediate wash, degreasing is carried out in a fresh bath with synthetic surfactants, preferably a combination of emulsifiers. Of the latter, 2 weight percent are added to the bath, which is then agitated for about 2 hours. After acid bating, the emulsifiable amount of fat will be from about 20 to 25 percent greater than when degreasing is carried out with a combination of emulsifiers alone.

The emulsifier combination preferably used for this purpose is composed of an ethoxylated alkylphenol and of an alkali metal sulfonate or ammonium alkylbenzene sulfonate in a ratio of 2:1, for example.

Wet blues can also be treated and wet degreased by the acid bating process described.

With regard to hydrophile-lipophile balance (HBL), reference is made to Römpps Chemi-Lexikon, 7th ed., Franckh'sche Verlagsbuchhandlung, Stuttgart, 1973.

The proteolytic activity of enzymes is best determined by the Löhlein-Volhard method ["Die Löhlein-Volhard'sche Methode zur Bestimmung der proteolytischen Aktivität ("The Löhlein-Volhard Method for Determination of Proteolytic Activity"), Gerbereitechnisches Taschenbuch, Dresden-Leipzig, 1955] and is expressed in Löhlein-Volhard units (LVU). One LVU is the amount of enzyme which under the specific conditions of the method will digest 1.725 mg of casein.

So far as determination of the activity of enzymes active in the acid pH range, based on the Anson method [M. L. Anson, J. Gen Physiol. 22, 79 (1939))], is concerned, the units are known as "proteinase units (hemoglobin)", or $U_{Hb}$. One $U_{Hb}$ is the amount of enzyme that will catalyst the liberation of fragments soluble in trichloroacetic acid from hemoglobin at a rate equivalent to 1 mole of tyrosine per minute at 37° C. (measured 280 nm). 1 $mU_{Hb}=10^{-3}U_{Hb}$.

In the examples which follow, "alkylphenol with 12 EO" means a $C_8$–$C_9$ alkylphenol ethoxylated with 12 ethylene oxide units.

The sodium alkylbenzene sulfonate used is the product "MARLON A 350" of Hüls having from 10 to 14 carbon atoms in the alkyl group.

The acid bate used is one based on fungal proteases from *A. parasiticus* or *A. oryzae*, for example the "EROPIC" products of Röhm GmbH.

The alkaline enzymatic bate used is a combination of pancreatic trypsin and a protease derived from *B. subtilis*, for example the product "OROPON OR" of Röhm GmbH.

The mineral oil employed has a content of aromatic hydrocarbons between 45 and 50 percent by weight.

EXAMPLE 1

| Comparative degreasing of pickled skivers before and after acid bating | | |
|---|---|---|
| Starting material: 8 New Zealand skivers. | | |
| The skivers are divided into left and right halves. | | |
| Pickled weight: | Left halves - 3.2 kg | |
| | Right halves - 3.8 kg. | |
| Degreasing of left halves before acid bating: | | |
| Depickling (drum): | 80.0% | water, 30° C. |
| | 5.0% | common salt |
| | | Agitate for 20 minutes. |
| | 1.5% | sodium bicarbonate |
| | | Agitate for 30 minutes. |
| | | Specific gravity, 9.5° Be; pH 6.5 |
| | 1.32% | nonylphenol with 12 EO |
| | 0.68% | sodium alkylbenzene sulfonate |
| | | Agitate for 2 hours. |
| Sampling of liquor for fat analysis. Found 8.37 g/half = 23.6%. (Fat of hides extractable with dichloromethane before degreasing = 100%). | | |
| Degreasing of right halves after acid bating: | | |
| Depickling (drum): | 80.0% | water, 30° C. |
| | 5.0% | common salt |
| | | Agitate for 20 minutes. |
| | 1.5% | sodium bicarbonate |
| | | Agitate for 30 minutes. |
| | | Specific gravity, 9.5° Be; pH 6.4 |
| | | Drain liquor. |
| Enzymatic loosening (drum): | | |
| | 100.0% | water, 30° C. |
| | 1.5% | acid bate with 30 $mU_{Hb}$ (Anson units) (520) from *A. oryzae* |
| | | Agitate 90 minutes. |
| | | Treating time: Overnight |
| | | Agitate every hour for 3 minutes. |
| Washing: | 200.0% | water, 30° C. |
| | | Agitate for 20 minutes. |
| | | Discard liquor. |
| Degreasing: | 80.0% | water, 30° C. |
| | 1.32% | alkylphenol with 12 EO |
| | 0.68% | sodium alkylbenzene sulfonate |
| | | Agitate for 2 hours. |

-continued

| Comparative degreasing of pickled skivers before and after acid bating |
|---|
| Sampling of liquor for fat analysis. Found 16.83 g/half = 47.4%. (Fat of hides extractable with dichloromethane before degreasing = 100%). |

Thus, after acid bating, the amount of fat emulsifiable with degreasing agents is found to be 23.8% greater.

EXAMPLE 2

COMPARATIVE DEGREASING TESTS ON U.S. PIGSKINS

Starting material: 10 U.S. pigskins, salted.

Salted weight: 55 kg.

The skins are first divided into left and right halves. In the various operations, the left halves are worked without the addition of degreasing agents and the right halves with degreasing agents.

| | | |
|---|---|---|
| Cleansing soak (drum): | 250.0% | water, 30° C. |
| | 0.18% | nonylphenol with 6.5 EO |
| | 0.18% | mineral oil |
| | 0.02% | nonylphenol with 4.0 EO |
| | 0.07% | petroleum |
| | 0.05% | ammonium cumene sulfonate |
| | | Agitate for 1 hour. |
| | | Take samples for fat analyses. |
| | | Discard liquor. |
| Main soak (drum): | 200.0% | water, 30° C. |
| | 0.5% | enzymatic protease from *B. licheniformis* having 4,000 LVU |
| | 0.5% | soda ash |
| | 1.0% | caustic soda sol., 33% |
| | 0.09% | nonylphenol with 6.5 O |
| | 0.09% | mineral oil |
| | 0.01% | nonylphenol with 4.0 EO |
| | 0.035% | petroleum |
| | 0.025% | ammonium cumene sulfonate |
| | | Agitate for 2 hours. |
| | | Take samples for fat analysis. |
| | | Discard liquor. |
| Liming (drum): | 50.0% | water, 30° C. |
| | 1.5% | lime |
| | 1.5% | sulfide-free liming aid |
| | 2.0% | sulfide lime |
| | 1.0% | caustic soda sol., 33% |
| | 0.10% | nonylphenol with 6.5 EO |
| | 0.10% | mineral oil |
| | 0.02% | nonylphenol with 4.0 EO |
| | 0.07% | petroleum |
| | 0.05% | ammonium cumene sulfonate |
| | | Agitate for 1 hour. |
| | 2.5% | lime |
| | 1.0% | caustic soda solution, 33% |
| | 70.0% | water, 25° C. |
| | | Overnight, agitate for 5 minutes every hour. |
| | | Take sample of lime liquor for fat analysis. |
| | | Discard liquor. |
| Washing (drum): | 200.0% | water, 28° C. |
| | | Agitate for 20 minutes. |
| | | Discard liquor. |
| | | Repeat washing operation once. |
| Deliming (drum): | 50.0% | water, 28° C. |
| | 2.0% | ammonium sulfate |
| | 0.6% | sodium bisulfite |
| | | Agitate for 30 minutes. |
| Bating (drum): | Add 100.0% | water, 37° C. |
| | 1.0% | enzymatic bate with trypsin |

-continued

| | | |
|---|---|---|
| | | and protease from *B. subtilis* having 300 LVU |
| | 0.18% | nonylphenol with 6.5 EO |
| | 0.18% | mineral oil |
| | 0.02% | nonylphenol with 4.0 EO |
| | 0.07% | petroleum |
| | 0.05% | ammonium cumene sulfonate |
| | | Agitate for 2 hours. |
| | | Take sample for fat analysis. |
| | | Discard liquor. |
| Washing (drum): | 200.0% | water, 26° C. |
| | | Agitate for 20 minutes. |
| | | Discard liquor. |
| Acid bating: | 100.0% | water, 25° C. |
| | 8.0% | common salt |
| | 1.5% | acid enzymatic bate with 30 $mU_{Hb}$ after Anson |
| | from *A. parasiticus* | |
| | Add 0.5% | formic acid 85%, diluted 1:10 |
| | | Agitate for 90 minutes. |
| | 0.66% | alkylphenol with 10 moles EO |
| | 0.34% | sodium alkylbenzene sulfonate |
| | | Agitate for 1 hour. |
| | | Take sample for fat analysis. |
| Pickling (drum): | Add 1.0% | sulfuric acid, conc., diluted 1:10 |
| | | Agitate for 1 hour. |
| | | Overnight, agitate for 5 minutes every hour. |
| | | Take sample of pickling liquor for fat analysis. |
| Tanning (drum): | Add 10.0% | "Chromosal B" (a basic chromium (III) sulfate) undissolved. |
| | | Agitate for 2 hours. |
| Basifying (drum): | Add 1.0% | sodium bicarbonate, 1:20, dissolved over 1 hour. |
| | | Keep drumming for 5 hours. |
| | | Final pH of tanning liquor, 3.8. |

| | Fat analyses | |
|---|---|---|
| Fat, grams/liter | Left halves | Right halves |
| Cleansing soak | 3.15 | 7.44 |
| Main soak | 25.36 | 24.86 |
| Liming | 12.17 | 15.31 |
| Bating | 2.99 | 8.66 |
| Acid bating | 2.00 | 8.75 |
| Pickling | 3.29 | 9.23 |
| After tanning | 1.27 | 7.64 |
| | 50.23 g/l | 81.89 g/l |
| | 100% | 163% |
| Fat content of wet blue | 10.1 | 4.4% based on dry weight |

EXAMPLE 3

Comparative degreasing tests on unsplit Canadian bull pelts in bating

| | | |
|---|---|---|
| Pelt weight: | 500 kg each for the left and right bull halves. The left halves were treated with degreasing agents, the right halves without degreasing agents. | |
| Deliming (drum): | 50.0% | water, 30° C. |
| | 3.5% | ammonium sulfate |
| | 0.5% | bisulfite |
| | | Agitate for 30 minutes. |
| Bating (drum): | Add 70.0% | water, 30° C. |
| | 0.6% | bate with 1,500 LVU of a combination of pancreatic trypsin and a protease derived from *B. subtilis* |
| | 0.2% | alkylphenol with 12 EO |

-continued

Comparative degreasing tests on unsplit Canadian bull pelts in bating

| | | |
|---|---|---|
| | 0.1% | sodium alkylbenzene sulfonate |
| | | Agitate for 1 hour. |

Take samples of bating liquors for fat analysis. Drain bating liquor. Fat content of bating liquor without degreasing agent, 1.6 g/l. Fat content of bating liquor with degreasing agent, 2.4 g/l.

By combining proteolytic enzymes in the bate with fat dissolving emulsifiers, a 50% increase in degreasing action was obtained. The finished leathers made from the material treated with a degreasing agent had greater fullness and a softer hand.

EXAMPLE 4

Process for the wet degreasing of hide and skin stock

| | | |
|---|---|---|
| Starting material: | 1 wet blue hide from a Canadian bullhide. | |
| Shaved thickness: | 1.8 mm | |
| Shaved weight: | 15.0 kg | |
| Washing (drum): | 200.0% | water, 40° C. |
| | 0.5% | acetic acid |
| | | Agitate 45 minutes. |
| | | Drain liquor. |
| Neutralization (drum) | 150.0% | water, 40° C. |
| | 1.0% | sodium formate |
| | | Agitate for 10 minutes. |
| | Add 0.7% | sodium bicarbonate dissolved 1:10 |
| | | Agitate for 30 minutes, pH 5.5. |
| | | Drain liquor. |
| Divide into four quarters | | |
| Test 4 (a) (drum): | 150.0% | water, 50° C. |
| | | Agitate for 3 hours. |
| | | Fat content of liquor, 0.12 g/l. |
| Test 4 (b) (drum): | 150.0% | water, 50° C. |
| | 0.35% | alkylphenol with 12 EO |
| | 0.15% | sodium alkylbenzene sulfonate |
| | | Agitate for 3 hours. |
| | | Fat content of liquor, 1.4 g/l. |
| Test 4 (c) (drum): | 150.0% | water, 50° C. |
| | 1.5% | acid bate with 30 $mU_{Hb}$ after Anson from *Aspergillus oryzae* |
| | | Agitate for 3 hours. |
| | | Fat content of liquor, 0.4 g/l |
| Test 4 (d) (drum): | 150.0% | water, 50° C. |
| | 1.5% | acid bate with 30 $mU_{Hb}$ after Anson from *A. oryzae.* |
| | 0.35% | alkylphenol with 12 EO |
| | 0.15% | sodium alkylbenzene sulfonate |
| | | Agitate for 3 hours. |
| | | Fat content of liquor, 2.0 g/l. |

If the fat content of the liquor from test 4(b), namely 1.4 g/l is taken as 100%, then combining the acid bate of test 4(c) with the degreasing agent of test 4(b) results in a fat content of the liquor from test 4(d) of 2.0 g/l, or 142.8%.

EXAMPLE 5

WET DEGREASING OF SALTED SHEEPSKINS IN THE SOAKING OPERATION

Comparative soaking tests are run with 100 kg each of dried sheepskins. In test (a), soaking is carried out solely with water with an inlet temperature of 30° C. The next morning, samples are taken and the fat content of the liquor is determined by the Seesand method. In test (b), 1 gram of an enzymatic softener from *Bacillus subtilis* having 1,750 LVU/g per liter of liquor is added under the same condition. The next morning, a sample is taken as in test (a) and its fat content is determined. In test (c), there is used, in addition to the substance of test (b), a surfactant mixture composed of 0.35 g of alkylphenol with 12 EO and 0.15 g of sodium alkylbenzene sulfonate per liter of liquor. The next morning, a sample is taken from the soaking liquor and analyzed for its fat content.

In test (d), soaking and wet degreasing are carried out with the addition of 0.35 g/l of alkylphenol with 12 EO and 0.15 g/g of sodium alkylbenzene sulfonate. Agitation, treating time and sampling as in test (a).

| | |
|---|---|
| Test (a): | |
| Raw stock: | 100 kg (dry weight) of dried German sheepskins. |
| Soaking (drum): | 800 l water, 28° C.<br>At the start, agitate for 30 minutes.<br>Allow to stand for 1 hour.<br>Agitate for 2 minutes at 90 minute intervals.<br>The next morning, take a sample of the liquor for fat analysis.<br>Fat content of liquor: 0.4 g/l |
| Test (b): | |
| Raw stock: | 100 kg (dry weight of dried German sheepskins. |
| Soaking (drum): | 800 l water, 28° C. |
| Wet degreasing: | 1 g enzymatic softening aid from *Bacillus subtilis* with 1,750 LVU/g per liter of liquor.<br>Agitation, treating time and sampling as in test (a).<br>Fat content of liquor: 0.7 g/l. |
| Test (c): | |
| Raw stock: | 100 kg (dry weight) of dried German sheepskins |
| Soaking (drum): | 800 l water, 28° C.<br>1 g enzymatic softening aid from *Bacillus subtilis* with 1,750 LVU/g per liter of liquor<br>0.35 g/l alkylphenol with 12 EO<br>0.15 g/l sodium alkylbenzene sulfonate<br>Agitation, treating time and sampling as in test (a).<br>Fat content of liquor: 1.94 g/l |
| Test (d): | |
| Raw stock: | 100 kg (dry weight) of dried German sheepskins |
| Soaking (drum): | 800 l water, 28° C.<br>0.35 g/l alkylphenol with 12 EO<br>0.15 g/l sodium alkylbenzene sulfonate<br>Agitation, treating time and sampling as in test (a).<br>Fat content of liquor: 1.67 g/l |

If the fat content of the liquor from the treatment with a surfactant mixture in test (d), namely 1.67 g/l, is taken as 100%, then the fat content of 1.94 g/l of liquor obtained in test (c) with a combination of enzymes and surfactant mixture represents 116.2%.

EXAMPLE 6

WET DEGREASING OF UNSPLIT CANADIAN BULL PELTS, LIMED, FLESHED AND WASHED

Divide each of two pelts into 4 quarters to give 8 quarters (Percentages based on pelt stock)

| | | |
|---|---|---|
| Test (a): | | |
| Wet degreasing (drum): | 50.0% | water, 27° C. |
| | 8.0% | sodium chloride |
| | 1.5% | ammonium sulfate |
| | | Agitate for 2 hours, pH 5.5. |
| | | Fat content of liquor: 0.44 g/l. |
| Test (b): | | |
| Wet degreasing (drum): | 50.0% | water, 27° C. |
| | 8.0% | sodium chloride |
| | 1.5% | ammonium sulfate |
| | 1.5% | enzymatic bate from *A. oryzae* with 30 $mU_{Hb}$ after Anson |
| | | Agitate for 2 hours, pH 5.5. |
| | | Fat content of liquor: 0.60 g/l. |
| Test (c): | | |
| Wet degreasing (drum): | 50.0% | water, 27° C. |
| | 8.0% | sodium chloride |
| | 1.5% | ammonium sulfate |
| | 1.35% | alkylphenol with 12 EO |
| | 0.15% | sodium alkylbenzene sulfonate |
| | | Agitate for 2 hours, pH 5.5. |
| | | Fat content of liquor: 8.54 g/l. |
| Test (d): | | |
| Wet degreasing (drum): | 50.0% | water, 27° C. |
| | 8.0% | sodium chloride |
| | 1.5% | ammonium sulfate |
| | 1.5% | enzymatic bate from *A. oryzae* with 30 $mU_{Hb}$ after Anson |
| | 0.35% | alkylphenol with 12 EO |
| | 0.15% | sodium alkylbenzene sulfonate |
| | | Agitate for 2 hours, pH 5.5. |
| | | Fat content of liquor: 13.6 g/l. |

If the fat content of the liquor from test (c) (wet degreasing with a surfactant mixture), namely 8.54 g/l, is taken as 100%, the increased fat content obtained in test (d) by combining said surfactant mixture with an enzymatic bate represents 159.2%.

What is claimed is:

1. A method for the wet degreasing of hide stock consisting of raw hides or skins, pelts, or wet blues under the conditions of enzymatic bating, which method involves enzymatically bating said hide stock with a bate consisting essentially of deliming agents, a proteolytic enzyme, and a combination of synthetic surface active substances including a nonionic emulsifier together with an anionic emulsifier.

2. A method as in claim 1 wherein said enzymatic bating is carried out in an acid pH range.

3. A method as in claim 1 wherein said emulsifiers have an HLB value, with respect to their oil-in-water emulsifying activity, from 8 to 18.

4. A method as in claim 3 wherein said HLB value is from 9 to 15.

5. A method as in claim 1 wherein said combination of synthetic surface active substances is present in an amount from 0.1 to 5 percent, by weight of the hide stock.

6. A method as in claim 1 wherein said combination of synthetic surface active substances is present in an amount from 0.2 to 1.5 percent, by weight of the hide stock.

7. A method as in claim 1 wherein said proteolytic enzyme is present in an amount from 0.01 to 3 percent, by weight of the hide stock, and has an enzymatic activity from 500 to 10,000 Löhlein-Volhard units per gram.

8. A method for the wet degreasing of hide stock consisting of raw hides or skins, pelts, or wet blues under the conditions of enzymatic bating, which method involves enzymatically bating said hide stock with a bate consisting essentially of deliming agents, a proteolytic enzyme in combination with an amylase, and a combination of synthetic surface active substances including a nonionic emulsifier together with an anionic emulsifier.

9. A method as in claim 8 wherein said enzymatic bating is carried out in the acid pH range.

10. A method as in claim 8 wherein said emulsifiers have an HLB value, with respect to their oil-in-water emulsifying activity, from 8 to 18.

11. A method as in claim 10 wherein said HLB value is from 9 to 15.

12. A method as in claim 8 wherein said combination of synthetic surface active substances is present in an amount from 0.1 to 5 percent, by weight of the hide stock.

13. A method as in claim 8 wherein said combination of surface active substances is present in an amount from 0.2 to 1.5 percent, by weight of the hide stock.

14. A method as in claim 8 wherein said proteolytic enzyme is present in an amount from 0.01 to 3 percent, by weight of the hide stock, and has an enzymatic activity from 500 to 10,000 Loehlein-Volhard units per gram.

* * * * *